US006811531B2

(12) United States Patent
Moscone, Sr.

(10) Patent No.: US 6,811,531 B2
(45) Date of Patent: Nov. 2, 2004

(54) HORIZONTAL CENTRIFUGE ROTOR

(76) Inventor: Kenneth J. Moscone, Sr., 1736 Cambridge Dr., State College, PA (US) 16803

( * ) Notice: Subject to any disclaimer, the term of this patent is extended or adjusted under 35 U.S.C. 154(b) by 25 days.

(21) Appl. No.: 10/128,927

(22) Filed: Apr. 22, 2002

(65) Prior Publication Data

US 2003/0199382 A1 Oct. 23, 2003

(51) Int. Cl.[7] ..... B04B 5/02
(52) U.S. Cl. ..... 494/20
(58) Field of Search ..... 494/16, 20, 21, 494/33

(56) References Cited

U.S. PATENT DOCUMENTS 4,391,597 A * 7/1983 Piramoon et al. ..... 494/20
4,435,169 A * 3/1984 Romanauskas ..... 494/20
4,585,434 A * 4/1986 Cole ..... 494/20
4,586,918 A * 5/1986 Cole ..... 494/20
4,589,864 A * 5/1986 Cole ..... 494/20
4,670,004 A * 6/1987 Sharples et al. ..... 494/20
4,718,885 A * 1/1988 Potter ..... 494/20
4,778,442 A 10/1988 Gordon
4,886,486 A * 12/1989 Grimm et al. ..... 494/20
4,941,867 A * 7/1990 Tominaga ..... 494/16
5,045,047 A * 9/1991 Hutchins et al. ..... 494/20

* cited by examiner

*Primary Examiner*—Charles E. Cooley
(74) *Attorney, Agent, or Firm*—McQuaide, Blasko, Schwartz, Fleming & Faulkner, Inc.

(57) ABSTRACT

A horizontal centrifuge rotor for use in existing and new centrifuges. The horizontal centrifuge rotor includes a rotor bottom with an outer rib encircling the rotor bottom. The outer rib extends upward from the rotor bottom to form an exterior wall about the rotor. There is at least one clearance slot for accepting a specimen holder with a collar. A support surface along each side of the clearance slot supports the specimen holder by the collar and allows rotation of the specimen holder about the collar from a vertical position to a horizontal position. There is a rotor hub in a center of the rotor bottom to allow mounting of the rotor to a motor drive shaft.

23 Claims, 8 Drawing Sheets

HORIZONTAL CENTRIFUGE ROTOR

BACKGROUND

The present invention generally relates to centrifuges for rotating a liquid based specimen. More particularly, the invention relates to a centrifuge rotor for rotating a liquid based specimen in a specimen holder, especially rotors used in medical and laboratory industries.

Centrifuges used in a laboratory setting usually include a housing which houses a motor and a rotor system. The motor is used to rotate the rotor system. The rotor system usually includes a rotor connected to the motor. The rotor includes a specimen holder that holds one or more liquid based specimens to be separated. The specimen holder may be a test tube, a test tube holder or any other means that is suitable for holding a liquid based specimen. The motor rotates the rotor, which in turn rotates the specimen holder. It is usually desirable to rotate the specimen holder in a horizontal position. The advantage of horizontal rotation is that all of the centrifugal force is applied to or transmitted along the vertical axis of the sample which results in maximum separation. In a fixed angular rotor there is a wasted vertical component of the centrifugal force that is trying to move the stationary specimen holder into a horizontal position. As a result, the same degree of separation can be achieved in a horizontal rotor in less time. Therefore, the specimen holder must move from a vertical position into a horizontal position, as the specimen holder is rotated and centrifugal force is exerted on the specimen holder.

There are many centrifuges on the market which use rotors to rotate a specimen in the horizontal position. However, the current rotor designs can be complicated with many moving parts. Some of the current rotor designs do not allow the specimen holder to rotate to a full horizontal position. Many of the current rotor designs do not protect the specimen holder from air resistance. Air resistance negatively affects the specimen holder in two ways. The first way is that there is more drag incurred and therefore a larger motor is required to rotate the rotor system, as opposed to having less drag and therefore a smaller motor. The second way is that the friction of the air resistance heats up the specimen holder means and its contents, which can be undesirable to the user.

Accordinaly, it is an object of the present invention to provide a rotor which is simple in design which allows the movement of a specimen holder from a vertical position to a full horizontal position.

It is another object of the present invention to provide a rotor which reduces the effects of air resistance on a specimen holder.

SUMMARY OF THE INVENTION

A horizontal centrifuge rotor for use in existing and new centrifuges. The horizontal centrifuge rotor includes a rotor bottom with an outer rib encircling the rotor bottom. The outer rib extends upward from the rotor bottom to form an exterior wall about the rotor. There is at least one clearance slot for accepting a specimen holder with a collar. A support surface along each side of the clearance slot supports the specimen holder by the collar and allows rotation of the specimen holder about the collar from a vertical position to a horizontal position. There is a rotor hub in the center of the rotor bottom to allow mounting of the rotor to a motor drive shaft.

DETAILED DESCRIPTION

As shown in the accompanying figures, the present invention is a horizontal centrifuge rotor for use in existing and new centrifuges that are typically used in medical and laboratory settings for rotating a liquid based specimen in a specimen holder. The horizontal centrifuge rotor 10 of the present invention incorporates the use of a specimen holder 12 with an extended collar 14. The specimen holder 12 can either hold a specimen or some type of container, such as a test tube which contains a specimen. The specimen holder 12 could be the test tube itself with a similar extended collar 14. The rotor 10 allows for the vertical or near vertical insertion of the specimen holder 12 and its contents. The collar 14 on the specimen holder 12 prevents the specimen holder 12 from falling through the rotor 10 and retains the specimen holder 12 during centrifugation.

The specimen holder 12 contents are able to achieve a full horizontal position during rotation, which in turn allows horizontal or straight-line separation of fluids of varying densities, or fluids and suspended solids, which are in the specimen holder 12. When the centrifuge stops spinning, the specimen holder 12 returns to its original or at rest position due to gravity, for easy removal. Any number and size of specimen holder 12 can be accommodated dependent only on the size of the rotor 10 and the specimen holder 12.

Figure 1:
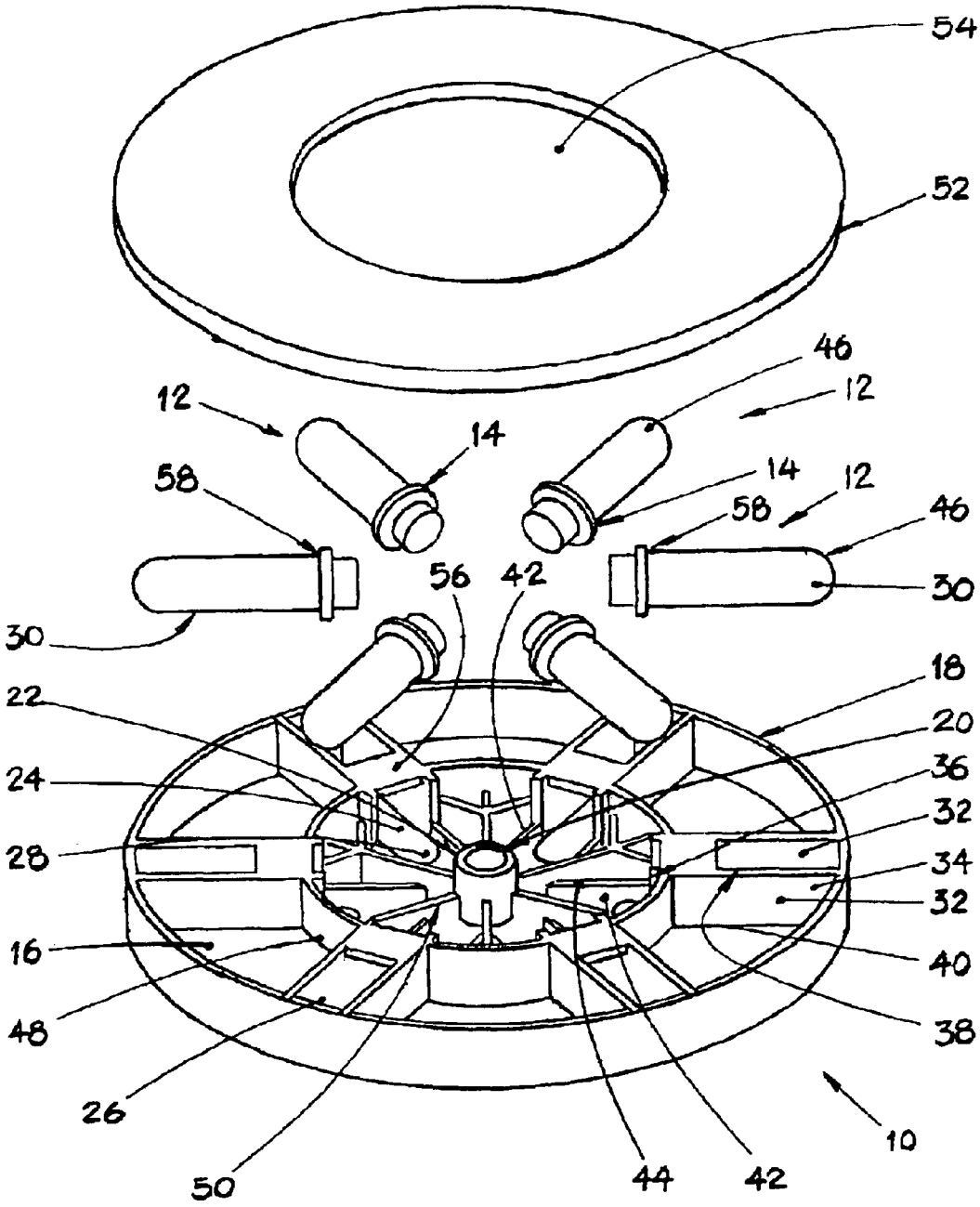
FIG. 1 is an exploded perspective view of components of a rotor according to a first embodiment of the present invention.
Figure 2:
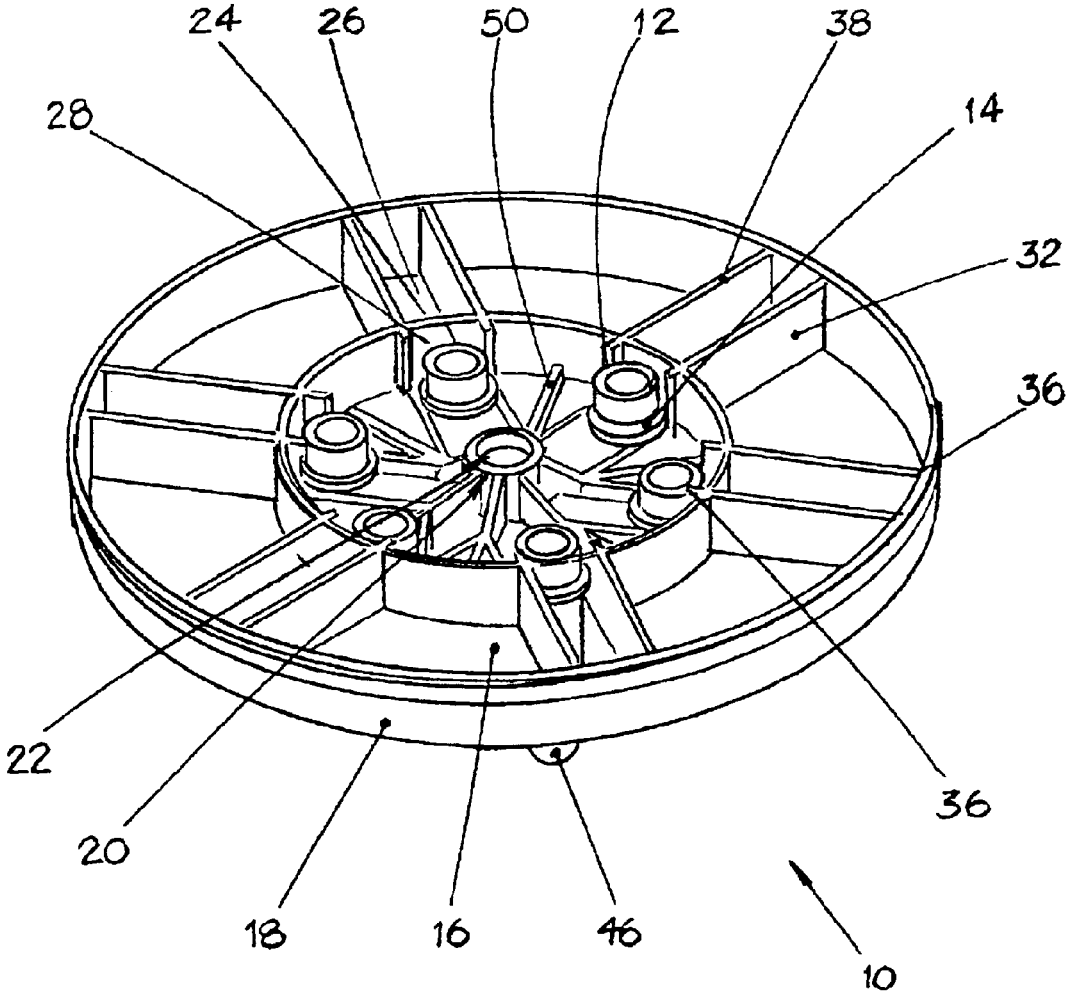
FIG. 2 is a perspective view of the rotor of FIG. 1 with specimen holders in the vertical position according to the present invention.
Figure 3:
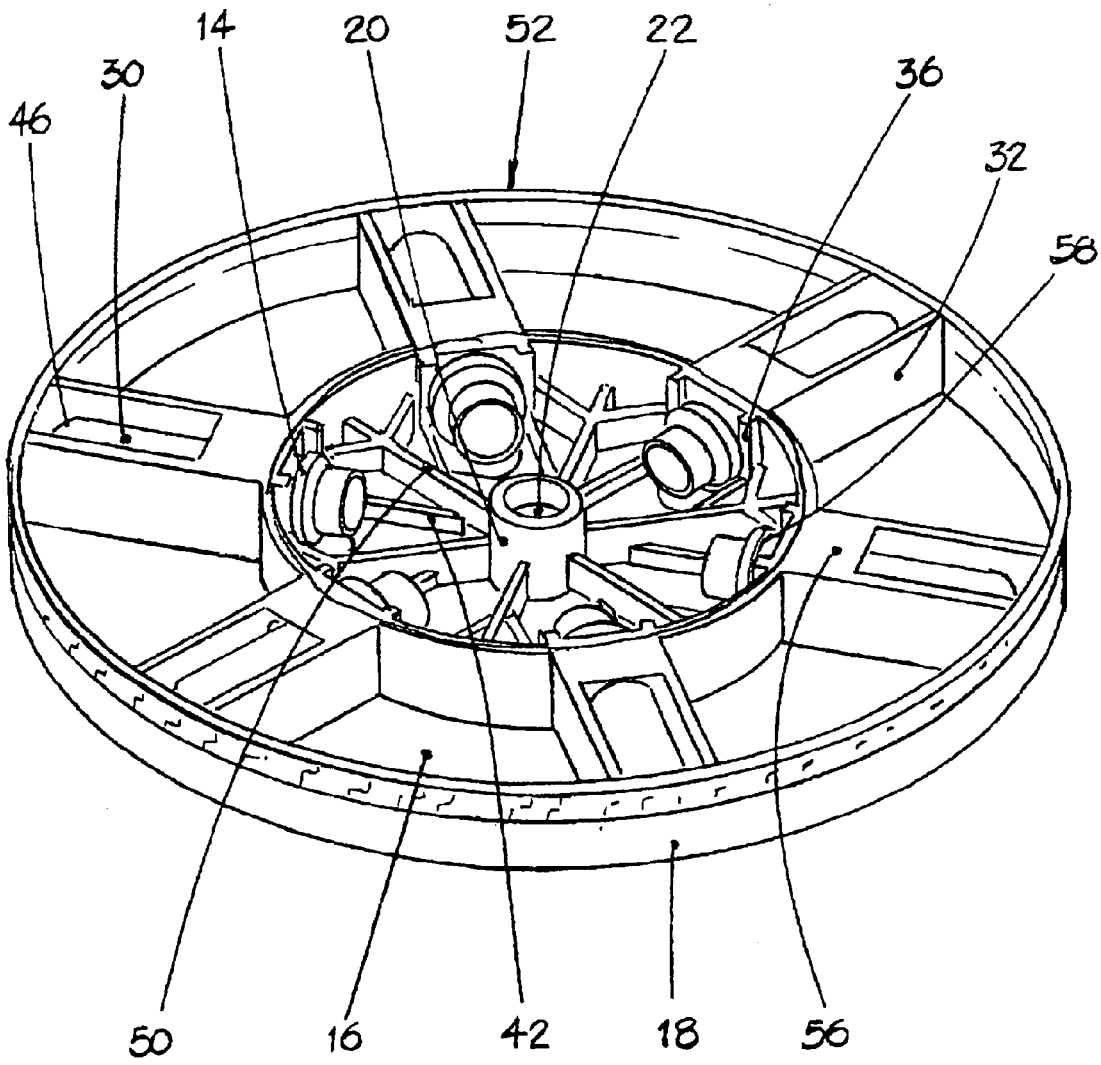
FIG. 3 is a perspective view of the rotor of FIG. 1 with specimen holders in the horizontal position according to the present invention.

As shown in FIGS. 1–3, the rotor 10 of the first embodiment is a ribbed disc which accepts the specimen holder 12. The rotor 10 is a round disc with a series of ribs that provide support or protect the specimen holder 12. The round disc forms the rotor bottom 16 of the rotor 10 to which all the ribs are attached. An outer rib 18 extends about the outside circumference of the rotor bottom 16. The outer rib 18 extends upward from the rotor bottom 16 to form an exterior wall about the specimen holder 12 and all the other ribs of the rotor 10. The outer rib 18 provides an aerodynamic shape to reduce air drag, protects the tip 46 of the specimen holder 12 and provides radial support to the rotor 10. At the center of the rotor bottom 16 is a rotor hub 20 extending upward from the rotor bottom 16. The rotor hub 20 has an open center 22 to fit over a drive shaft of a centrifuge motor. The rotor hub 20 acts as a bearing surface for the rotor 10.

There is a series of six clearance slots 24 about the bottom of the rotor 10 to receive a series of specimen holders 12, as shown in FIGS. 1–3. There can be more or fewer clearance slot 24 in the rotor 10. Each clearance slot 24 has an exterior end 26 near the outer rib 18 and an interior end 28 near the rotor hub 20. The clearance slot 24 allows the specimen holder 12 to swing from a vertical position into a horizontal position during rotation of the rotor, so as to be recessed within the outer rib 18 of the rotor 10. The clearance slot 24 must be wider than the main body 30 of the specimen holder 12, but smaller than the diameter of the collar 14 of the specimen holder 12. Extending upward from the rotor bottom 16 on each side of the clearance slot 24 is a side rib 32. Each side rib 32 is shown flush with the clearance slot 24. Each side rib 32 includes an exterior end 34, an interior end 36, a top 38 and a bottom 40.

The length of the ends 34, 36 forms the height of the side rib 32 and the length of the top 38 and bottom 40 forms the length of the side rib 32. The exterior end 34 is against the inside of the outer rib 18. The bottom 40 of the side rib 32 is against the rotor bottom 16. The top 38 of the side rib 32 is parallel with the rotor bottom 16 and flush with a top edge of the outer rib 18. The interior end 36 of the side rib 32 is positioned towards the rotor hub 20 and forms a ninety degree (90°) angle with the rotor bottom 16. The interior end 36 acts as a support surface for the collar 14 of the specimen holder 12, when the specimen holder 12 is in the horizontal position during rotation. The length of the side rib 32 terminates before the length of the clearance slot 24 to allow the insertion of the specimen holder 12 and take into account the dimensions of the collar 14. The side rib 32 also provides radial strength to the rotor 10.

Extending from the interior end 36 of each side rib 32 and towards the rotor hub 20 are holder support ribs 42. The holder support ribs 42 extend upward from the rotor bottom 16 and are only a fraction of the height of the side ribs 32. The holder support ribs 42 provide radial strength to the rotor 10 and serve as a support for the collar 14 of the specimen holder 12 in the horizontal position, vertical position and any position in between. The distance between the holder support ribs 42 on each side of a clearance slot 24 should be slightly wider than the width of the clearance slot 24, but smaller than the diameter of the collar 14 of the specimen holder 12. A top surface 44 of the holder support rib 42 is shown parallel to the rotor bottom 16 and intersects the interior end 36 of the side rib 32 at a ninety degree (90°) angle. The distance from the holder support rib 42 to the inside surface of the outer rib 18 must be greater than the length of the specimen holder 12 from a lower surface 58 of the collar 14 to the tip 46 of the specimen holder 12.

In each area between the clearance slots 24 there is an inner rib 48 positioned between the side rib 32 and near the interior end 36 of the side rib 32. The inner rib 48 provides side strength to the side rib 32, strengthens the rotor 10 and prevents foreign objects from getting into the center area of the rotor 10. Running between the rotor hub 20 and each of the inner ribs 48 is a structural rib 50. The structural rib 50 provides radial support to the rotor 10 and the holder support ribs 42 which intersect the structural rib 50 as shown in FIGS. 1–3.

Figure 4:
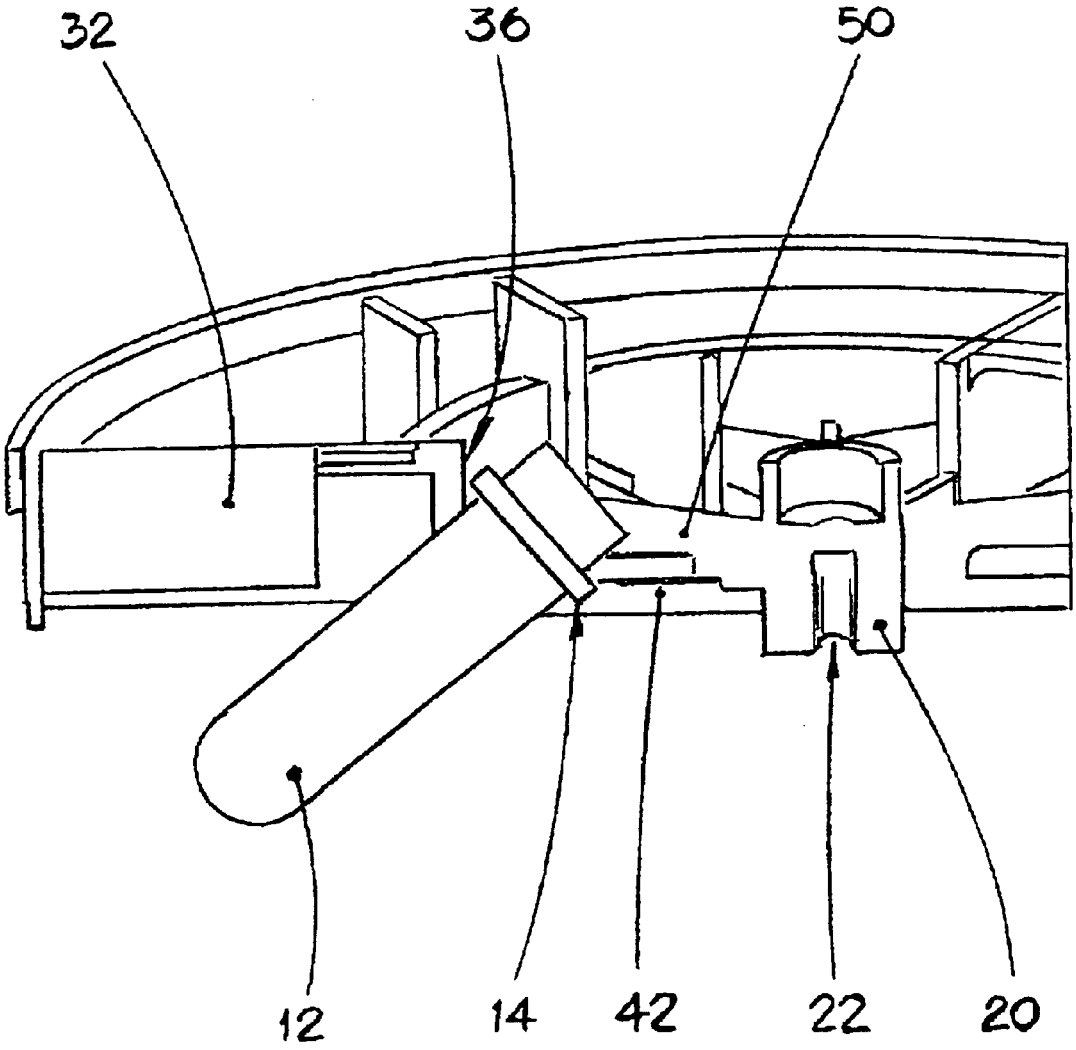
FIG. 4 is a partial cross-sectional view of the rotor of FIG. 1 with specimen holders at rest in a near vertical position according to the present invention.

FIG. 1 shows a semi-transparent flat cover 52 which fits over the top of the rotor 10 to protect the insides of the rotor 10. The cover 52 is also used to retain the specimen holder 12 from moving beyond the horizontal position during rotation and to provide a more aerodynamic air flow over the rotor 10. The cover 52 includes a center hole 54 to allow insertion of the specimen holder 12, when the rotor 10 is at rest. FIGS. 1 and 3 show an arch 56 between each set of side ribs 32 associated with a clearance slot 24. The arch 56 is shown at the interior end 36 of the side rib 32, but could be positioned anywhere along the side rib 32. The arch 56 is another means besides the cover 52 to prevent movement of the specimen holder 12 beyond the horizontal position during rotation. FIG. 4 shows the specimen holder 12 positioned in a near vertical position due to the design of the rotor 10. In FIG. 4, the distance between the interior end 36 of the side rib 32 and the interior end 28 of the clearance slot 24 is less than the diameter of the main body 30 of the specimen holder 12. This forces the specimen holder 12 to be placed in the rotor 10 at an angle, whereby the collar 14 rests against both the interior end 36 of the side rib 32 and the top surface 44 of the holder support ribs 42. Positioning the specimen holder 12 at a near vertical position as shown in FIG. 4 accounts for any components of the centrifuge that the specimen holder 12 might hit during rotation.

The rotor 10 is utilized by being mounted to a drive shaft of the motor of the centrifuge. The specimen holder 12 is placed into the clearance slot 24 at the interior end of the slot 24. The collar 14 of the specimen holder 12 is allowed to rest against the holder support ribs 42 associated with each clearance slot 24, whereby the collar 14 supports the specimen holder 12 in a vertical position in the rotor 10. A lower surface 58 of the collar 14 of the specimen holder 12 rests flush against the top surface of the holder support ribs 42. The cover 52 is placed over the rotor 10 or already be in place during insertion of the specimen holder 12. Any additional components of the centrifuge are properly positioned. The rotor 10 is rotated by the motor. The centrifugal force of rotation causes the tip 46 of the specimen holder 12 to rotate upward about the collar 14 from a vertical position to a horizontal position, as shown in FIGS. 2 and 3. When the specimen holder 12 is in the horizontal position, the lower surface 58 of the collar 14 of the specimen holder 12 rests against the interior end 36 of the side ribs 32. When the specimen holder 12 is in the horizontal position, the rotor 10 protects the specimen holder 12. When rotation of the rotor 10 is terminated, the specimen holder 12 returns to its original vertical position, due to gravity.

There are several advantages provided by the rotor 10 of the first embodiment. Primarily, the rotor enables the specimen holder 12 to rotate from a vertical position to a full horizontal position using a simple, non-mechanized means that relies only on the support surfaces formed in the rotor 10 itself, as well as the collar 14 of the specimen holder 12. Other than the specimen holder 12, there are no other moving parts. When the specimen holders 12 are in the full horizontal position, the specimen holders 12 are recessed within the rotor 10. This reduces air resistance during rotation, permitting a smaller horsepower motor to be used in order to achieve a desired separation speed. Also, when the specimen holders 12 are recessed within the rotor 10, they are not subjected to the friction of air resistance during rotation and do not heat up due to the friction.

FIGS. 5–8 show the rotor 60 of a second embodiment of the present invention. The rotor 60 includes a rotor bottom 16, outer rib 18 and rotor hub 20, similar to the rotor 10 of the first embodiment. As in the first embodiment, the outer rib 18 extends about the outside circumference of the rotor bottom 16. The outer rib 18 extends upward from the rotor bottom 16 to form an exterior wall of the rotor 60 about the area containing the specimen holder 12. The outer rib 18 provides an aerodynamic shape to reduce air drag, protects the tip 46 of the specimen holder 12 and provides radial support to the rotor 60. As in the first embodiment, there is a rotor hub 20 (not shown) at the center of the rotor bottom 16, which extends upward from the rotor bottom 16. The rotor hub 20 has an open center 22 to fit over a drive shaft of a centrifuge motor. The rotor hub 20 acts as a bearing surface for the rotor 60.

Figure 5:
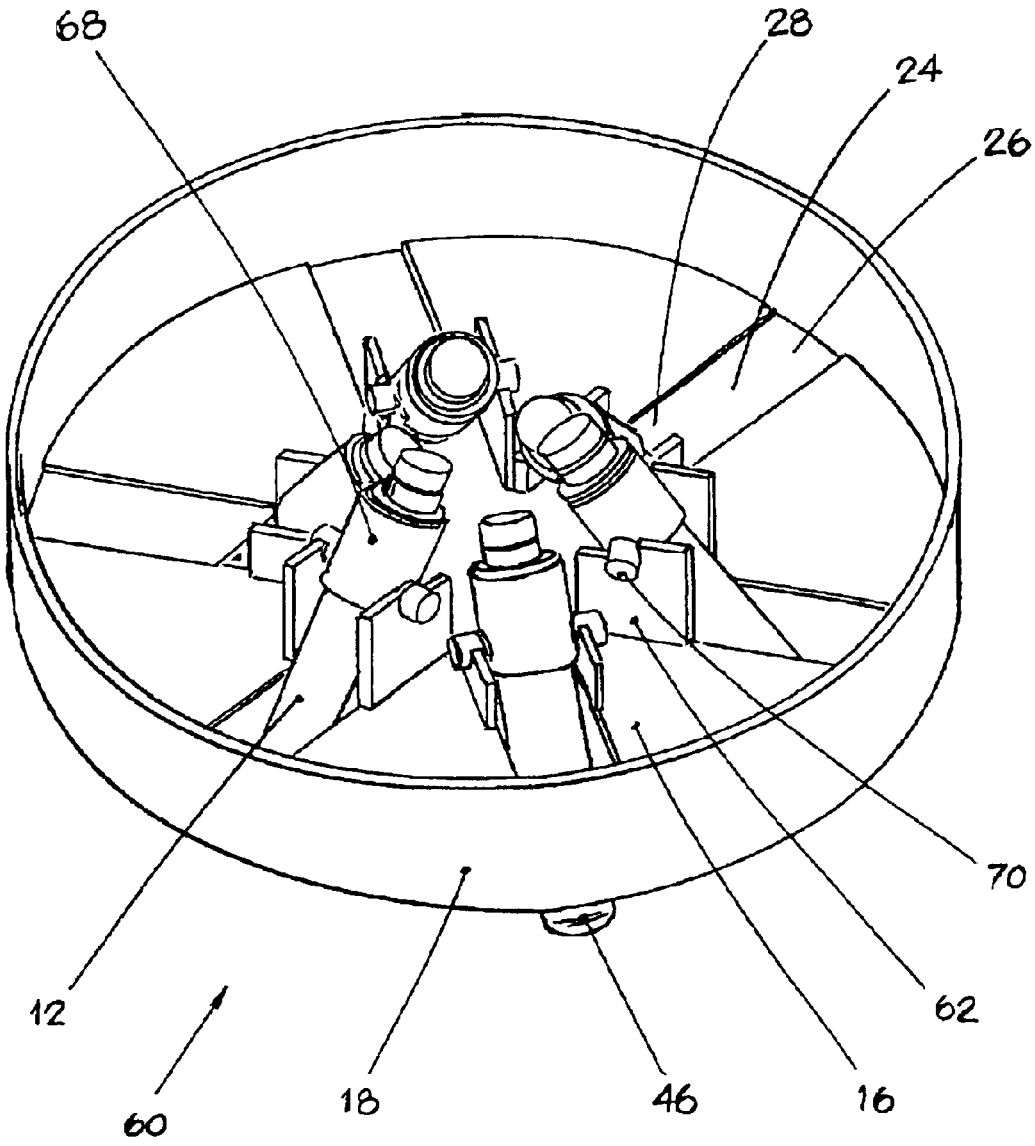
FIG. 5 is a perspective view of a rotor with specimen holders in the vertical position according to a second embodiment of the present invention.
Figure 6:
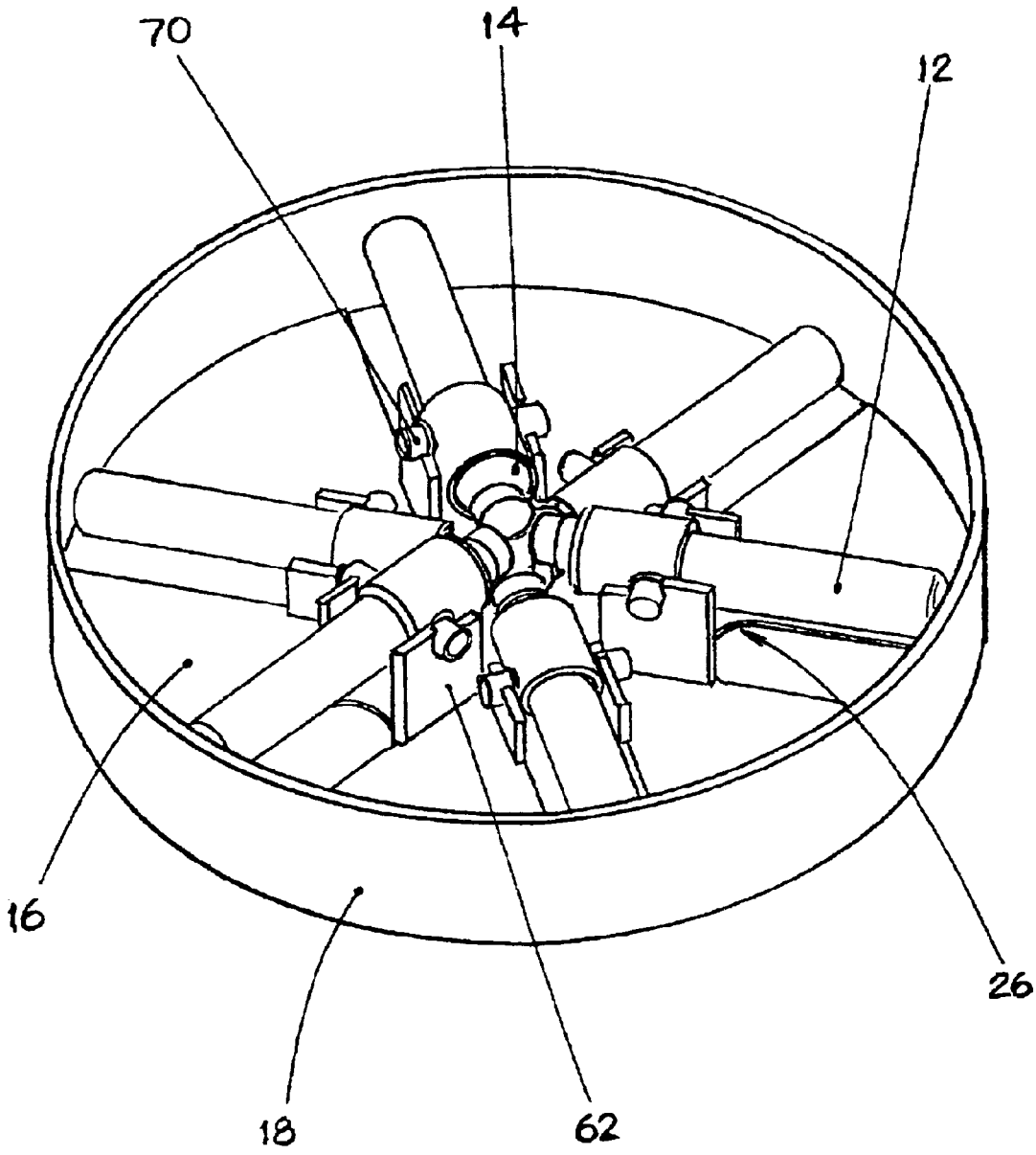
FIG. 6 is a perspective view of the rotor of FIG. 5 with specimen holders in the horizontal position according to the present invention.
Figure 7:
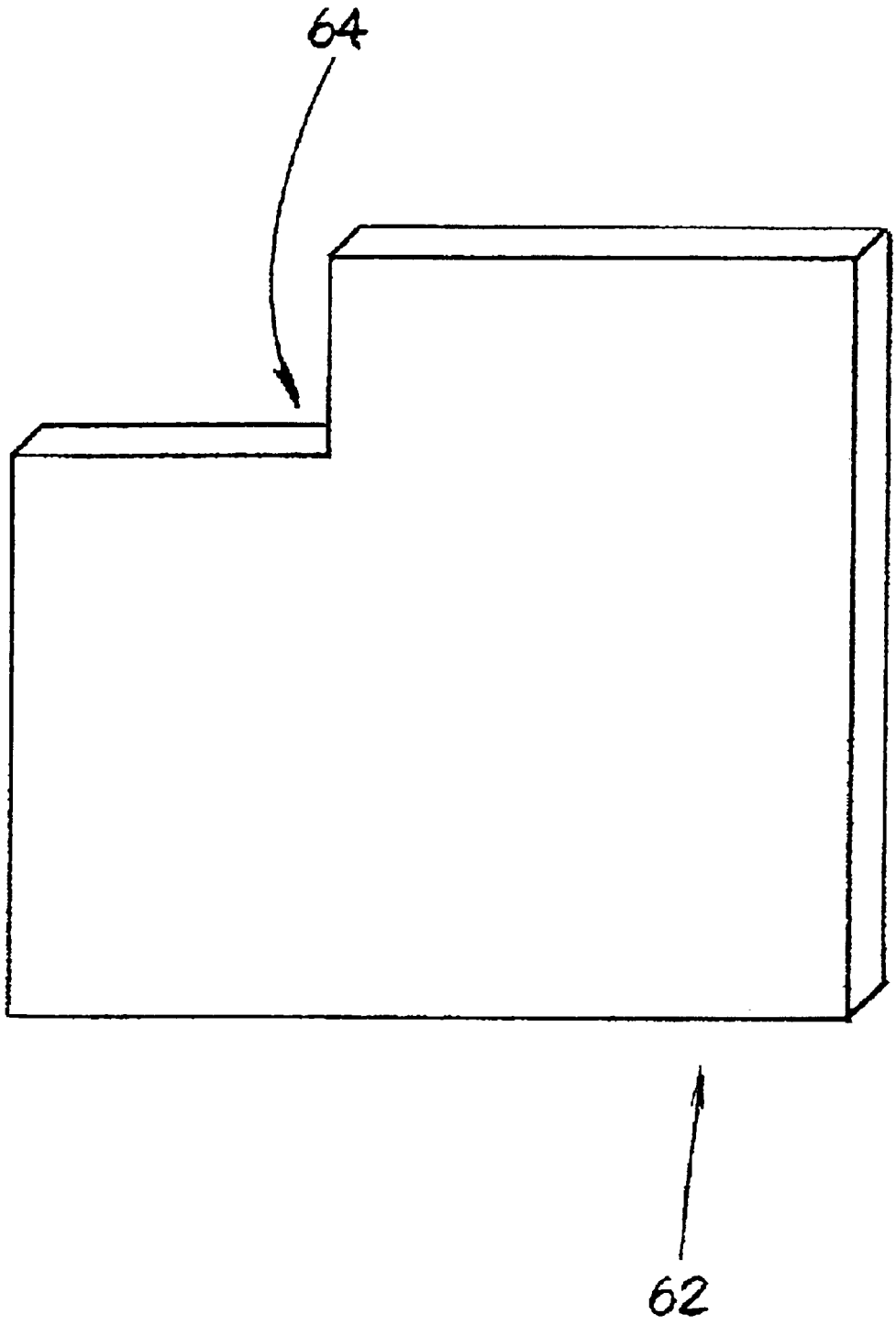
FIG. 7 is a perspective view of a side support of the rotor of FIG. 5 according to the present invention.
Figure 8:
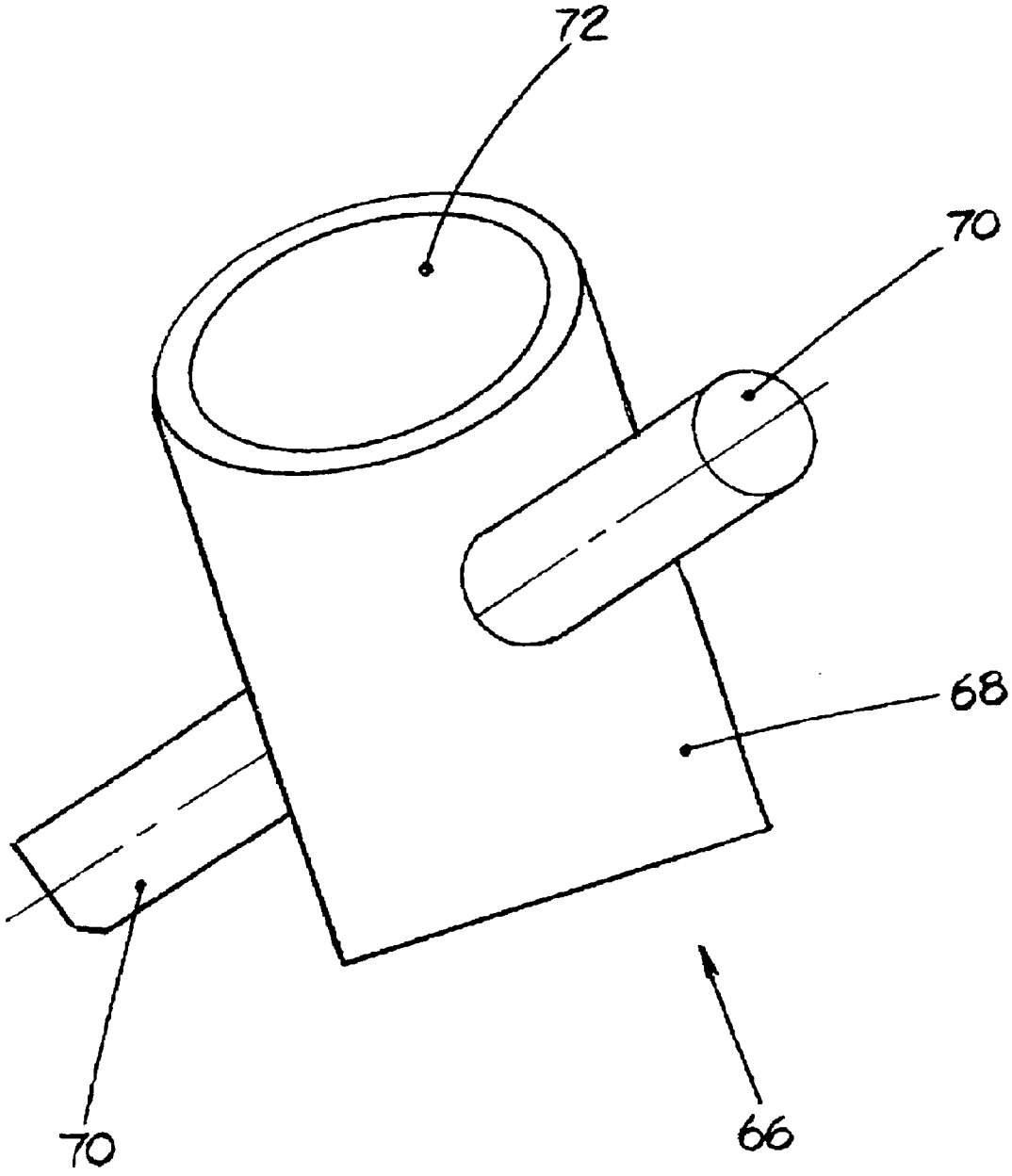
FIG. 8 is a perspective view of a specimen holder receiver of the rotor of FIG. 5 according to the present invention.

Similar to the first embodiment, there is a series of six clearance slots 24 about the bottom of the rotor 60 to receive a series of specimen holders 12, as shows in FIGS. 5–6. Each clearance slot 24 has an exterior end 26 near the outer rib 18 and an interior end 28 near the rotor hub 20. The clearance slot 24 allows the specimen holder 12 to swing from a vertical position into a horizontal position, so as to be recessed within the outer rib 18 of the rotor 60. The clearance slot 24 must be wider than the main body 30 of the specimen holder 12. Extending upward from the rotor bottom 16 on each side of the clearance slot 24 and near the interior end 28 of the clearance slot 24 is a side support 62, as shown in FIGS. 5–7. Each side support 62 includes an L-shaped notch 64 in a top surface of the side support 62. The L-shaped notch 64 is used to support a specimen holder receiver 66. The specimen holder receiver 66 includes a cylinder shaped receiver 68 and rotation pins 70. The specimen holder receiver 66 includes an open center 72 to receive a specimen holder 12, as shown in FIG. 8. The open center 72 should be large enough to receive a main body 30 of the specimen holder 12, but small enough to retain the specimen holder 12 at the collar 14 of the specimen holder 12. The rotation pins 70 extend from the specimen holder receiver 66 and are aligned along the same axis, as shown in FIG. 8.

As shown in FIGS. 5–6, the height of the L-shaped notches 64 on each side of a clearance slot 24 is lower than that of the we L-shaped notches 64 flanking adjacent clearance slots. This allows "nesting" of specimen holders 12 of the higher L-shaped notches 64 over the specimen holders 12 of the lower L-shaped notches 64, as shown in FIG. 6. Nesting allows the inclusion of a greater number of specimen holders 12 in a smaller diameter rotor. The distance of the clearance slot 24 from the rotation pin 70 of the specimen holder receiver 66 to the inside surface of the outer rib 18 must be greater than the length of the specimen holder 12 from the rotation pin 70 to the tip 46 of the specimen holder 12.

The rotor 60 is utilized by being mounted to a drive shaft of the motor of the centrifuge. The specimen holder 12 is placed into the specimen holder receiver 66 and enters the clearance slot 24 at the interior end 28 of each clearance slot 24. The lower surface 58 of the collar 14 of the specimen holder 12 rests against a top surface of the specimen holder receiver 66, whereby the collar 14 supports the specimen holder 12 in a vertical position in the rotor 60. The cover 52 is placed over the rotor 60 or may already be in place during insertion of the specimen holder 12. Any additional components of the centrifuge are properly positioned. The rotor 60 is rotated by the motor. The centrifugal force of rotation causes the tip 46 of the specimen holder 12 to rotate upward about the rotation pin 70 from a vertical position to a horizontal position, as shown in FIGS. 5 and 6. When the specimen holders 12 are in the horizontal position, the rotor 60 protects the specimen holders 12. When rotation of the rotor 60 is terminated, the specimen holders 12 return to their original vertical position, due to gravity.

The rotor 60 of the second embodiment provides the following advantages. The rotor enables the specimen holder 12 to rotate from a vertical position to a full horizontal position using a simple, non-mechanized means that relies only on the rotation pin 70 and the side support 62. Other than the rotation pin 70, there are no other moving parts. When the specimen holders 12 are in the full horizontal position, the specimen holders 12 are recessed within the rotor 60. This reduces air resistance during rotation and allows a smaller horsepower motor to be used in order to achieve the desired separation speed. Also, when the specimen holders 12 are recessed within the rotor 60, they are not subjected to the friction of air resistance during rotation and do not heat up due to the friction.

While different embodiments of the invention have been described in detail herein, it will be appreciated by those skilled in the art that various modifications and alternatives to the embodiments could be developed in light of the overall teachings of the disclosure. Accordingly, the particular arrangements are illustrative only and are not limiting as to the scope of the invention that is to be given the full breadth of any and all equivalents thereof.

I claim:

1. A rotor, for a centrifuge, comprising:

a) A rotor bottom;

b) an outer rib encircling said rotor bottom and extending upward from said rotor bottom to form an exterior wall about said rotor;

c) at least one clearance slot for accepting a specimen holder with a collar;

d) a support surface along each side of said clearance slot for supporting the specimen holder by the collar to allow rotation of the specimen holder about the collar from a rest position to a horizontal position;

e) a rotor hub in a center of said rotor bottom to allow mounting of the rotor to a motor drive system;

f) a specimen holder receiver including an open center to receive the specimen holder and two rotation pins extending out from said receiver along a single axis of rotation, wherein said support surface engages and supports said specimen holder receiver about one of said rotation pins and includes a notch to receive said pins; and wherein the support surfaces of one clearance slot are lower than the support surfaces of clearance slots on each side of said lower support surfaces to allow nesting of test tubes in the specimen holders.

2. The rotor of claim 1, further including a cover for a top of said rotor to cover most of the specimen holder during rotation of said rotor.

3. The rotor of claim 1, wherein said notch is L-shaped.

4. The rotor of claim 1, wherein said support surfaces include side ribs along each side of said clearance slot to act as a support surface for the collar of the specimen holder while in the horizontal position.

5. The rotor of claim 1, wherein said support surfaces include support holder ribs between said outer rib and said rotor hub, positioned along each side of said clearance slot to act as a support surface for the collar of the specimen holder while in the rest position.

6. The rotor of claim 1, further including an inner rib between said support surfaces in areas where there are no clearance slots.

7. The rotor of claim 6, further including structural ribs running between said inner rib and said rotor hub.

8. A rotor, for a centrifuge, comprising:

a) a rotor bottom;

b) an outer rib encircling said rotor bottom and extending upward from said rotor bottom to form an exterior wall about said rotor;

c) a rotor hub in a center of said rotor bottom to allow mounting of the rotor to a motor drive system;

d) at least one clearance slot for accepting a specimen holder with a collar;

e) a support surface along each side of said clearance slot for supporting the specimen holder by the collar to allow rotation of the specimen holder about the collar from a rest position to a horizontal position;

f) a specimen holder receiver including an open center for receiving the specimen holder and rotation pins extending out from said receiver, wherein said support surface engages and supports said specimen holder receiver about one of said rotation pins; and wherein the support surfaces of one clearance slot are lower than the support surfaces of clearance slots on each side of said lower support surfaces to allow nesting of test tubes in the specimen holders.

9. The rotor of claim 8, further including cover for a top of said rotor to cover most of the specimen holder during rotation of said rotor.

10. The rotor of claim 8, wherein said support surface includes a notch to receive said pins.

11. The rotor of claim 8, wherein said specimen holder receiver comprises a cylinder.

12. A rotor, for a centrifuge, comprising:

a) a rotor bottom;

b) a rotor hub in a center of said rotor bottom to allow mounting of the rotor to a motor drive system;

c) at least one cleareance slot for accepting a specimen holder with a collar;

d) a support surface along each side of said clearance slot for supporting the specimen holder by the collar to allow rotation of the specimen holder about the collar from a rest position to a horizontal position;

e) a specimen holder receiver including an open center for receiving the specimen holder and rotation pins extending out from said receiver, wherein said support surface engages and supports said specimen holder receiver about one of said rotation pins; and wherein the support surfaces of one clearance slot are lower than the support surfaces of clearance slots on each side of said lower support surfaces to allow nesting of test tubes in the specimen holders.

13. The rotor of claim 12, wherein said support surface includes a notch to receive said pins.

14. The rotor of claim 12, wherein said specimen holder receiver comprises a cylinder.

15. A rotor, for a centrifuge, comprising:

a) a rotor bottom;

b) a rotor hub in a center of said rotor bottom to allow mounting of the rotor to a motor drive system;

c) at least one clearance slot for accepting a specimen holder with a collar;

d) a support surface along each side of the clearance slot for supporting the specimen holder by the collar to allow rotation of the specimen holder about the collar from a rest position to a horizontal position;

e) a specimen holder receiver including an open center for receiving the specimen holder and rotation pins extending out from said receiver, wherein said support surface engages and supports said specimen holder receiver about one of said rotation pins; and wherein the support surfaces of one clearance slot are lower than the support surfaces of clearance slots on each side of said lower support surfaces to allow nesting of test tubes in the specimen holders.

16. The rotor of claim 15, wherein said support surface includes a notch to receive said pins.

17. The rotor of claim 15, wherein said specimen holder receiver comprises a cylinder.

18. A rotor, for a centrifuge, comprising:

a) a rotor bottom;

b) a rotor hub in a center of said rotor bottom to allow mounting of the rotor to a motor drive system;

c) at least one clearance slot for accepting a specimen holder with a collar;

d) an outer rib encircling said rotor bottom and extending upward from said rotor bottom to form an exterior wall about said rotor;

e) a support surface along each side of the clearance slot for supporting the specimen holder by the collar to allow rotation of the specimen holder about the collar from a rest position to a horizontal position;

e) a specimen holder receiver including an open center for receiving the specimen holder, wherein said support surface engages and supports said specimen holder receiver; and wherein the support surfaces of one clearance slot are lower than the support surfaces of clearance slots on each side of said lower support surfaces to allow nesting of test tubes in the specimen holders.

19. The rotor of claim 18, wherein said support surface includes a notch.

20. The rotor of claim 18, wherein said specimen holder receiver comprises a cylinder.

21. A rotor, for a centrifuge, comprising:

a) a rotor bottom;

b) at least one clearance slot for accepting a specimen holder with a collar;

c) a support surface along each side of said clearance slot for supporting the specimen holder by the collar to allow rotation of the specimen holder about the collar from a vertical position to a horizontal position;

d) a rotor hub in a center of said rotor bottom to allow mounting of the rotor to a motor drive shaft;

e) a specimen holder receiver including an open center for receiving the specimen holder, wherein said support surface engages and supports said specimen holder receiver; and wherein the support surfaces of one clearance slot are lower than the support surfaces of clearance slots on each side of said lower support surfaces to allow nesting of test tubes in the specimen holders.

22. The rotor of claim 21, wherein said support surface includes a notch.

23. The rotor of claim 21, wherein said specimen holder receiver comprises a cylinder.

* * * * *